US006390463B1

(12) United States Patent
Iwago

(10) Patent No.: US 6,390,463 B1
(45) Date of Patent: May 21, 2002

(54) PAPER FEEDER

(75) Inventor: Toshitaka Iwago, Okazaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/645,524

(22) Filed: Aug. 25, 2000

(30) Foreign Application Priority Data

Aug. 27, 1999 (JP) ..... 11-241494

(51) Int. Cl.[7] ..... B65H 3/06
(52) U.S. Cl. ..... 271/118; 271/121
(58) Field of Search ..... 271/117, 118, 271/121

(56) References Cited

U.S. PATENT DOCUMENTS 4,934,686 A * 6/1990 Ono ..... 271/117
5,085,420 A * 2/1992 Sata ..... 271/118
5,624,109 A * 4/1997 Tanaka ..... 271/118

FOREIGN PATENT DOCUMENTS

JP 0156241 * 6/1989 ..... 271/118

* cited by examiner

*Primary Examiner*—H. Grant Skaggs
(74) *Attorney, Agent, or Firm*—Oliff & Berridge, PLC

(57) ABSTRACT

In a paper feeder, after a set of the documents has been fed, a lifting member transmits the rotation of a separation roller shaft to a frame member, as the separation roller shaft is rotated opposite to the direction to feed documents, by a predetermined amount. Accordingly, the frame member is turned upwardly, so as to lift a pick-up roller away from a paper feed slope where the documents are to be stacked. With this structure, another set of the documents can be readily set with the leading edges thereof placed under the pick-up roller after the first set of the documents has been fed. Further, when the documents are fed, a force such that the pick-up roller is lifted up away from the paper feed slope is not externally applied to the frame member leaving the pick-up roller in contact with the documents. Consequently, the documents can be stably fed out.

17 Claims, 5 Drawing Sheets

PAPER FEEDER

BACKGROUND OF THE INVENTION

1. Field of Invention

The invention relates to a paper feeder for use in an image forming apparatus, such as a copying machine, a printer, and a facsimile machine. More particularly, it relates to the paper feeder that stably feeds out paper, such as a document.

2. Description of Related Art

Conventional paper feeders that are employed in, for example, facsimile machines, include a separation roller to separate pages from a stack of documents, one by one, and a pick-up roller, disposed upstream of the separation roller in a document feeding direction, to feed out the pages in the feeding direction thereof. Typically, the separation roller and the pick-up roller are rotatably supported by a frame member.

An example of a conventional paper feeder 50 is shown in FIG. 5. FIG. 5 is a schematic, partially sectional side view of the conventional paper feeder 50. A set of documents P is stacked on a paper feed slope 51. A separation pad 52, disposed downstream of the paper feed slope 51 in the document P feeding direction (right side in FIG. 5), separates leading edges of the documents P, one by one. Disposed above the separation pad 52, is a separation roller 53. The separation roller 53 separates pages from the stack of the documents P, one by one, in cooperation with the separation pad 52, and transfers the pages of the documents P in the feeding direction thereof. The separation roller 53 is mounted on a separation roller shaft 53*a,* which extends through the frame member 54. The separation roller 53 is rotatably supported by the separation roller shaft 53*a,* in the body of the image reading device 2. Mounted on the separation roller shaft 53*a,* near one end of the separation roller 53, is a gear (not shown), that is engaged with an idle gear 56 (described below), to transmit the rotation of the separation roller 53 thereto.

Disposed on the document P feeding upstream side in the frame member 54 (left side in FIG. 5), is a pick-up roller 55. Similar to the separation roller 53, the pickup roller 55 transfers separated individual pages of the documents P in the feeding direction thereof. The pick-up roller 55 is rotatably supported by a pick-up roller shaft 55*a* in the frame member 54. Mounted on the pick-up roller shaft 55*a,* near one end of the pick-up roller 55, is a gear (not shown) that is engaged with the idle gear 56, to transmit the rotation of the pick-up roller 55 thereto, similar to the separation roller 53.

Between the pick-up roller 55 and the separation roller 53, the idle gear 56 is disposed in a position where the idle gear 56 is engaged with each gear mounted near the ends of the separation roller 53 and the pick-up roller 55. The idle gear 56 transmits the rotation of the separation roller 53 to the pick-up roller 55, while being engaged with the gears mounted near the separation roller 53 and the pick-up roller 55.

The idle gear 56 is rotatably supported by an idle gear shaft 56*a,* which is provided on the frame member 54. In FIG. 5, an outer circle of the idle gear 56 indicates an addendum circle. An inner circle of the idle gear 56 indicates a dedendum circle. A circle written in dot-dash lines between the outer and the inner circles of the idle gear 56 indicates a pitch circle of the idle gear 56.

As described above, the idle gear 56 is disposed between the pick-up roller 55 and the separation roller 53, in a position where the idle gear 56 is engaged with each gear mounted near the ends of the separation roller 53 and the pick-up roller 55. With this structure, the separation roller 53 and the pick-up roller 55 may rotate in the same direction. A top page of the documents P, may be transferred in the feeding direction thereof, by the separation roller 53, the pick-up roller 55, and the separation pad 52.

Loading a set of documents P on the paper feed slope 51 is difficult if the pick-up roller 55 makes contact with an upper surface of the paper feed slope 51. Conventionally, a hook 54*a* protruding upwardly from an upper portion of the frame member 54, and another hook 50*a* protruding downwardly from the body of the paper feeder 50 are connected by an extension spring 57. A user pulls upwardly the pick-up roller 55 to load a set of documents P on the paper feed slope 51.

As the set of documents P is loaded and the feeding thereof is started, the user moves the pick-up roller 55 down, so that the separation roller 53 and the pick-up roller 55 make contact with the top page of the documents P. Then, the separation roller 53 and the pick-up roller 55 start to rotate in the direction to feed the documents P in the feeding direction thereof.

However, with the above-described structure, the pick-up roller 55 is pulled upwardly by the extension spring 57, even after the document P feeding is started. Therefore, the pick-up roller 55 unstably makes contact with the documents P, resulting in an unstable feeding thereof.

SUMMARY OF THE INVENTION

One aspect of the invention is to provide a paper feeder that stably feeds out paper, such as a document. To achieve this aspect, the paper feeder of the invention may include a separation roller that separates a plurality of stacked documents, one by one, a pick-up roller that is disposed upstream of the separation roller in a document feeding direction, and that feeds out the documents toward the separation roller, a frame member that supports a rotating shaft for the separation roller and a rotating shaft for the pick-up roller, and a lifting member that turns the frame member in a direction away from a document positioning portion, so as to move the pick-up roller away from the document positioning portion, by transmitting a rotation of the rotating shaft for the separation roller to the frame member, when the rotating shaft for the separation roller rotates opposite to a direction to feed the documents in the document feeding direction.

In the paper feeder, after a set of the documents has been fed, the lifting member transmits the rotation of the rotating shaft for the separation roller to the frame member, as the rotating shaft for the separation roller rotates opposite to the direction to feed documents in the document feeding direction, by a predetermined amount. Accordingly, the frame member is turned in the direction away from the document positioning portion, so as to move the pick-up roller away therefrom.

In the paper feeder of the invention, the lifting member may include a frame collar that projects from an insertion portion of the rotating shaft for the separation roller in the frame member, the frame collar placing the rotating shaft for the separation roller therein, a first collar that is disposed near the frame collar and rotatably inserted over the rotating shaft for the separation roller, a second collar that is disposed near a first collar end opposite to the frame collar, and fixedly inserted over the rotating shaft for the separation roller, a first clutch member that places the frame collar and the first collar therein, wherein when the rotating shaft for the separation roller rotates in the direction to feed the documents in the document feeding direction, the first clutch member causes the frame collar and the first collar to separately and independently act, and when the rotating shaft for the separation roller rotates opposite to the direction to the document feeding direction, the first clutch member causes the frame collar and the first collar to act as one-piece, and a second clutch member that places the first collar and the second collar therein, wherein when the rotating shaft for the separation roller rotates in the direction to feed the documents in the document feeding direction, the second clutch member causes the first collar and the second collar to act as one-piece, and when the rotating shaft for the separation roller rotates opposite to the document feeding direction, the second clutch member causes the first collar and the second collar to act as one-piece, until a predetermined torque is produced on the rotating shaft for the separation roller, and the second clutch member causes the first collar and the second collar to separately and independently act, as a torque equal to or greater than the predetermined torque is produced on the rotating shaft for the separation roller, when the rotating shaft for the separation roller rotates opposite to the direction to the document feeding direction.

When the rotating shaft for the separation roller rotates in the document feeding direction, the first clutch member causes the frame collar protruding from the frame member and the first collar rotatably inserted over the rotating shaft for the separation roller to separately and independently act, and the second clutch member causes the first collar and the second collar fixed to the rotating shaft for the separation roller to act as one-piece. Accordingly, the rotating shaft for the separation roller may rotate in the direction to feed the documents in the document feeding direction. When the rotating shaft for the separation roller rotates opposite to the direction to the document feeding direction and the predetermined torque is not produced on the rotating shaft for the separation roller, the first clutch member and the second clutch member cause the frame collar, the first collar, and the second collar to act as one-piece. When the rotating shaft for the separation roller rotates opposite to the document feeding direction and the torque equal to or greater than the predetermined torque is produced on the rotating shaft for the separation roller, the first clutch member causes the frame collar and the first collar to act as one-piece and the second clutch member causes the first collar and the second collar to separately and independently act.

In the paper feeder, the first clutch member may include a bearing-type one-way clutch that allows the first collar to rotate only in the direction to feed the documents in the document feeding direction.

When the documents are fed in the document feeding direction, the rotating shaft for the separation roller may be rotated to feed the documents in document feeding direction, by the act of the bearing-type one-way clutch and the first collar separately and independently. When the frame member is turned so as to lift the pick-up roller, the rotation of the rotating shaft for the separation roller is transmitted to the frame member by the act of the bearing-type one-way clutch and the first collar as one-piece.

In the paper feeder, the second clutch member may include a spring-type one-way clutch that has a spring wound around outer surfaces of the first collar and the second collar. When the rotating shaft for the separation roller rotates in the direction to feed the documents in the document feeding direction, an inside diameter of the spring surrounding the first collar and the second collar, becomes smaller, the spring presses the outer surfaces of the first collar and the second collar and the first collar and the second collar act as one-piece. When the rotating shaft for the separation roller rotates opposite to the direction to feed the documents in the document feeding direction, with a torque less than the predetermined torque produced, the inside diameter of the spring surrounding the first collar and the second collar remains smaller, the spring presses the outer surfaces of the first collar and the second collar and the first collar and the second collar act as one-piece. When the rotating shaft for the separation roller rotates opposite to the direction to feed the documents in the document feeding direction, with the torque equal to or greater than the predetermined torque produced, the inside diameter of the spring surrounding the first collar and the second collar becomes larger than the outside diameters of the first collar and the second collar, and the first collar and the second collar act separately and independently.

When the rotating shaft for the separation roller rotates in the direction to feed the documents in the document feeding direction, the first collar and the second collar act as one-piece as the inside diameter of the spring surrounding the first collar and the second collar becomes smaller, so that the outer surfaces of the first collar and the second collar are pressed down. When the rotating shaft for the separation roller rotates opposite to the direction to feed the documents in the document feeding direction, with a torque less than the predetermined torque produced, the first collar and the second collar act as one-piece as the inside diameter of the spring surrounding the first collar and the second collar remains smaller, so that the outer surfaces of the first collar and the second collar are pressed down. When the rotating shaft for the separation roller rotates opposite to the direction to feed the documents in the document feeding direction, with the torque equal to or greater than the predetermined torque produced, the first collar and the second collar act separately and independently as the inside diameter of the spring surrounding the first collar and the second collar becomes larger than the outside diameters of the first collar and the second collar.

The paper feeder may further include a cover that covers the frame member, a cover protruding member that is disposed in the cover on a side of the frame member, and a frame protruding member that is formed on the frame member, upstream of the separation roller in the document feeding direction, and that lifts the frame member on a side of the pick-up roller by making the frame member rotate about the rotating shaft for the separation roller, with the frame protruding member, when the cover is closed.

As the cover is closed, the cover protruding member presses down the frame protruding member, so that the frame member turns about the rotating shaft for the separation roller so as to lift the pick-up roller.

In the paper feeder, the cover protruding member is formed of a plate spring.

Because the cover protruding member is formed of a plate spring, the cover protruding member may slide down toward the rotating shaft for the separation roller after the cover protruding member presses down the frame protruding member.

BRIEF DESCRIPTION OF THE DRAWINGS

Preferred embodiments of the invention will be described in detail with reference to the following figures wherein.

Figure 1:
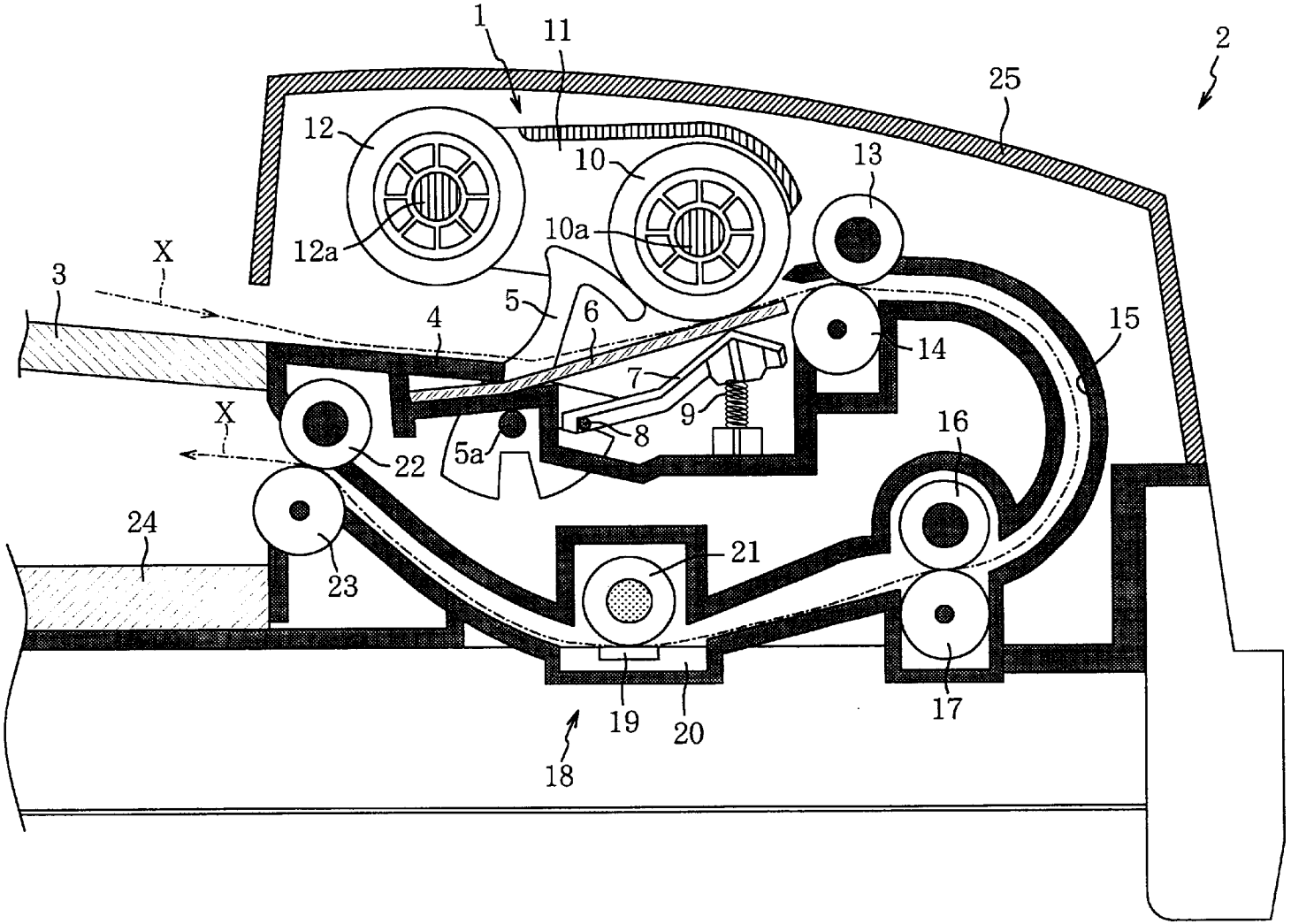
FIG. 1 is a schematic sectional side view of an image reading device including a paper feeder according to an embodiment of the invention illustrating an internal structure of the image reading device.

Further objects, details, and advantages of the invention will be apparent from the following detailed description, when read in conjunction with the drawings.

DETAILED DESCRIPTION OF PREFERRED EMBODIMENTS

Preferred embodiments of the invention will be described in detail with reference to the accompanying drawings.

A paper feeder 1 according to an embodiment of the invention includes a separation roller 10, a pick-up roller 12, and a frame member 11 which will be described below in detail. The paper feeder 1 may be set in, for example, an image reading device 2 for use in a facsimile machine.

FIG. 1 is a schematic, sectional side view of the image reading device 2 of a facsimile machine including the paper feeder 1 according to an embodiment of the invention illustrating an internal structure of the image reading device 2. The image reading device 2 including the paper feeder 1, is disposed at an upper portion of the facsimile machine. In FIG. 1, dot-dash lines with arrows X show the feeding direction and the path of documents P.

As shown in FIG. 1, disposed upstream in the document P feeding direction (left upper side in FIG. 1), is a paper feed tray 3 formed substantially in a plate shape. The paper feed tray 3 is tilted downwardly toward the document P feeding direction. Provided downstream of the paper feed tray 3, in the document P feeding direction, is a paper feed slope 4 that guides the pages of the documents P, stacked on the paper feed tray 3, inside the image reading device 2. Similar to the paper feed tray 3 the paper feed slope 4 is tilted downwardly, toward the document P feeding direction. The documents P are loaded onto the paper feed tray 3 with the side having images facing up.

Near the distal end of the paper feed slope 4, a front actuator 5, whose upper portion is formed like a hook, is supported so as to rotate about a fulcrum 5*a*. As a page of the documents P supplied from the paper feed tray 3 reaches the front actuator 5, though the paper feed slope 4, the front actuator 5 is pushed forward by the page and rotates about the fulcrum 5*a*. By the rotation of the front actuator 5, a sensor (not shown) senses the page is being fed.

Disposed downstream of the paper feed slope 4, in the document P feeding direction, is a separation pad 6 formed in a substantially flat plate shape. The separation pad 6 is tilted upwardly toward the document P feeding direction. The separation pad 6 is made of a synthetic resin material having flexibility, such as silicone rubber. The separation pad 6 separates leading edges of the documents P stacked on the paper feed slope 4, one by one, in cooperation with the separation roller 10. As described above, the separation pad 6 is made of a material, such as silicone rubber that possess a high skin-friction coefficient, so that the pages of the documents P contacting the separation pad 6 are dragged and separated, one by one.

Disposed below the separation pad 6 is a raising member 7 formed in a substantially boomerang shape. The raising member 7 raises the separation pad 6 upwardly. The raising member 7 is mounted in the body of the image reading device 2 so as to rotate about a hinge 8. Provided below the raising member 7 is a compression spring 9. With the expanding force of the compression spring 9, the raising member 7 is urged or raised toward the separation pad 6.

Disposed above the separation pad 6 is the separation roller 10, that separates the pages of the documents P, one by one, in cooperation with the separation pad 6, and that feeds the separated individual pages of documents P in the feeding direction thereof. The separation roller 10 is mounted on a separation roller shaft 10*a* which extends through the frame member 11. The separation roller 10 is rotatably supported by the separation roller shaft 10*a*, in the body of the image reading device 2. Disposed on the document P feeding upstream side in the frame member 11 (left side in FIG. 1), is the pick-up roller 12 that feeds out the separated individual pages, of the documents P, in the feeding direction thereof, similar to the separation roller 10. The pick-up roller 12 is rotatably supported by a pick-up roller shaft 12*a* in the frame member 11. A top page of the documents P is fed by the separation roller 10 and the pick-up roller 12 between a first transferring roller 13 and a first presser roller 14.

The frame member 11 rotatably supporting the separation roller 10 and the pick-up roller 12 by means of shafts 10*a* and 12*a*, is supported in the body of the image reading device 2 so as to rotate about the separation roller shaft 10*a*. When the pick-up roller 12 is making contact with the paper feed slope 4 a set of the documents P cannot be properly loaded on the paper feed slope 4. Therefore, when a set of the documents P is loaded on the paper feed slope 4, the frame member 11 turns about the separation roller shaft 10*a* so as to raise the pick-up roller 12. After the set of documents P has been loaded on the paper feed slope 4, the pick-up roller 12 needs to contact the documents P surface to feed the documents P. At this time, the frame member 11 turns about the separation roller shaft 10*a* so as to lower the pick-up roller 12. The paper feeding mechanism of the paper feeder 1 will be described in detail below.

Disposed downstream of the separation pad 6, in the document P feeding direction, is the first transferring roller 13 that transfers the individual pages of the documents P in the feeding direction thereof. Disposed below the first transferring roller 13 is the first presser roller 14 that presses the documents P against the first transferring roller 13. The first transferring roller 13 and the first presser roller 14 are rotatably supported by shafts in the body of the image reading device 2. A curved portion 15 is formed downstream of the first transferring roller 13 and the first presser roller 14 in the document P feeding direction. As the pages of the documents P are passed through the curved portion 15, they are turned over.

Disposed at the end of the curved portion 15 is a second transferring roller 16, that feeds the pages of the documents P in the feeding direction thereof. Disposed below the second transferring roller 16, is a second presser roller 17 that presses the feed document P against the second transferring roller 16. The second transferring roller 16, and the second presser roller 17, are rotatably supported by shafts in the body of the image reading device 2. The pages of the document P separated one by one, with the aid of the separation pad 6, are transferred between the first transferring roller 13 and the first presser roller 14, and then between the second transferring roller 16 and the second presser roller 17. The documents P are conveyed to the image reader 18, at a predetermined velocity, as the first and second transferring rollers 13, 16 rotate.

Disposed downstream of the second transferring roller 16 and the second presser roller 17, in the document P feeding direction, is the image reader 18 that reads images on the fed document page P.

The image reader 18 includes a contact image sensor (CIS) 19 that reads images on the document page P, an image reading member 20 provided with the CIS 19, and a platen roller 21 that transfers the pages of the documents P while pressing the passed document P against the image reading member 20. A strip of white tape is placed around the surface of the platen roller 21, as a reference for the white color, when the images on the documents P are read. The platen roller 21 may be a white platen roller whose surface is formed in white.

The pages of the documents P transferred by the second transferring roller 16 and the second presser roller 17, are pressed by the platen roller 21 onto the image reading member 20 provided with the CIS 19. Thus, the images on the documents P are read in the image reader 18.

Disposed downstream of the image reader 18, in the document P feeding direction, is a discharge roller 22 that discharges the pages of the documents P, subjected to the image reading, out of the image reading device 2. Disposed below the discharge roller 22, is a discharge presser roller 23 that presses the passing document page P against the discharge roller 22. The discharge roller 22 and the discharge presser roller 23 are rotatably supported by shafts in the body of the image reading device 2. The pages of the documents P, subjected to the image reading in the image reader 18, are transferred between the discharge roller 22 and the discharge presser roller 23, at a predetermined velocity, as the discharge roller 22 rotates. Thus, the documents P are discharged out of the image reading device 2.

Disposed at a lower downstream side of the discharge roller 22 and the discharge presser roller 23, in the document P feeding direction, is a generally plate-shaped discharge tray 24, that receives the pages of the documents P, which are subjected to image reading and are discharged out of the image reading device 2. As the pages of the documents P are discharged, they are stacked on the discharge tray 24, with the side having images facing down. A cover 25, to protect the image reading device 2, is provided in an upper portion of the image reading device 2, above the paper feed path where the pages of the documents P are fed from the paper feed slope 4 to the discharge roller 22, through the curved portion 15.

Figure 2:
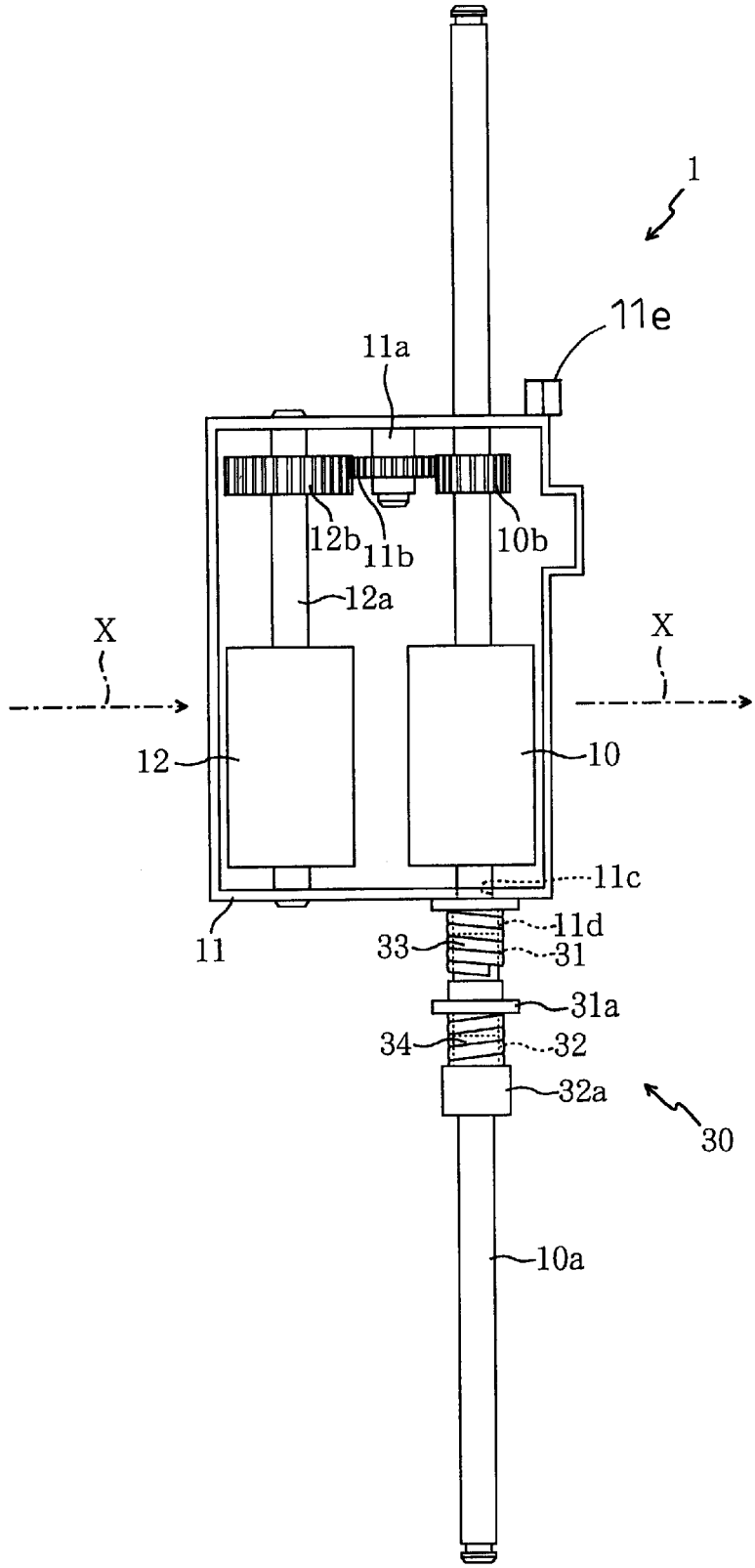
FIG. 2 is a plan view of the paper feeder according to a first embodiment of the invention.

With reference to FIG. 2, the paper feeder 1 according to a first embodiment of the invention will be described below. FIG. 2 is a plan view of the paper feeder 1, according to the first embodiment of the invention. To facilitate understanding of the paper feeder 1 according to the first embodiment, an upper, or covering, portion of the frame member 11 is not shown in FIG. 2. The dot-dash lines with arrows X in FIG. 2 indicate the document P feeding direction, similar to that illustrated in FIG. 1.

Disposed in the substantially central portion of the paper feeder 1, is the separation roller 10. As described above, the separation roller 10 is mounted on the separation roller shaft 10*a* which extends through the frame member 11. The separation roller 10 is rotatably supported, by the separation roller shaft 10*a*, in the body of the image reading device 2. Disposed near an end of the separation roller 10, inside the frame member 11, is a separation gear 10*b* that transmits the rotation of the separation roller 10 to an idle gear 11*b* (described below). The separation gear 10*b* is fixedly mounted on the separation roller shaft 10*a*. As the separation roller shaft 10*a* rotates, the separation gear 10*b* so rotates as does the idle gear 11*b*.

Disposed on the document P feeding upstream side of the frame member 11 (left side in FIG. 2), is the pick-up roller 12 that feeds out the separated individual pages of the documents P in the feeding direction thereof, similar to the separation roller 10. The pick-up roller 12 is rotatably supported, by the pick-up roller shaft 12*a*, in the frame member 11. Disposed near an end of the pick-up roller 12, inside the frame member 11, is a pick-up gear 12*b* that transmits the rotation of the idle gear 11*b* to the pick-up roller 12. The pick-up gear 12*b* is fixedly mounted on the pick-up roller shaft 12*a*. As the idle gear 11*b* rotates, the pick-up gear 12*b* is rotated and the pick-up roller 12 rotates.

Between the pick-up gear 12*b* and the separation gear 10*b*, the idle gear 11*b* is disposed so as to engage both the pick-up gear 12*b* and the separation gear 10*b*. The idle gear 11*b* transmits the rotation of the separation roller 10 to the pick-up roller 12. The idle gear 11*b* is rotatably supported, by an idle gear shaft 11*a*, in the frame member 11.

With the above-described structure, such that the idle gear 11 is disposed between the separation gear 10*b* and the pick-up gear 12*b*, the separation roller 10 and the pick-up roller 12 can be rotated in the same direction. Accordingly, a page of the documents P stacked on the top may be transferred, in the feeding direction thereof, by the separation roller 10 and the pick-up roller 12 rotating in the same direction.

Disposed on the separation roller shaft 10*a*, outside the frame member 11, is a lifting member 30. The lifting member 30 lifts the frame member 11 on the side of the pick-up roller 12, in the following manner. When the separation roller 10 rotates opposite to the direction to feed the documents P in the feeding direction thereof, the rotation of the separation roller shaft 10*a*, is transmitted to the frame member 11. With the rotation of the separation roller shaft 10*a* transmitted to the frame member 11, the frame member 11 turns upwardly, so as to raise the pick-up roller 12. Thus, the pick-up roller 12 moves away from the paper feed slope 4 where the documents P are to be loaded. The lifting member 30 includes a frame collar 11*d*, a first collar 31, a parting wall 31*a*, a second collar 32, a guard wall 32*a*, a first spring clutch 33, and a second spring clutch 34.

Near an insertion portion 11*c*, in the frame member 11 to insert the separation roller shaft 10*a* thereinto, the cylindrical-shaped frame collar 11*d* is extended. The separation roller shaft 10*a* passes through the inside of the frame collar 11*d*, protruding out of the frame member 11. The frame collar 11*d* is integrated with the frame member 11. Inside the frame collar 11*d*, the separation roller shaft 10*a* can rotate.

Disposed near an end of the frame collar 11*d* on the separation roller shaft 10*a*, is the first collar 31 that is formed in a substantially cylindrical shape. The first collar 31 is rotatably fitted over the separation roller shaft 10*a*. Accordingly, the first collar 31 and the separation roller shaft 10*a* can individually rotate. Provided in a substantially central portion of the first collar 31, is a parting wall 31*a* which is substantially formed in a hollow disk shape. The parting wall 31*a* provides space or separation between the first and second spring clutches 33, 34, which will be described below in detail.

Disposed near the first collar 31 end opposite to the frame collar 11*d*, is the second collar 32 that is formed in a substantially cylindrical shape. The second collar 32 is fixedly inserted over the separation roller shaft 10*a*. Accordingly, the second collar 32 and the separation roller shaft 10*a* rotate together as one-piece. Provided at the second collar 32 end, opposite to the frame collar 11*d*, is the substantially hollow disk-shaped guard wall 32*a*. The guard wall 32*a* prevents the second spring clutch 34 from coming off.

The first and second spring clutches 33, 34, are wound around the outer surfaces of the first and second collars 31, 32, respectively, so that the transmission of the separation roller shaft 10*a* rotation to the frame member 11 is controlled.

The first spring clutch 33, as a first clutch member, which is formed like a substantially spiral spring, is wound around the outer surfaces of the frame collar 11*d* and a part of the first collar 31, appearing to one side of the parting wall 31 a as shown in FIG. 2. When the separation roller shaft 10*a* rotates in the direction to feed the documents P in the feeding direction thereof, the spring of the first spring clutch 33 unwraps, so as to make the diameter thereof larger. When the separation roller shaft 10*a* rotates opposite to the direction to feed the documents P in the feeding direction thereof, the spring of the first spring clutch 33 wraps so as to make the diameter thereof smaller. More specifically, when the separation roller shaft 10*a* rotates in the feeding direction, the first collar 31 rotates/stops independently of the frame collar 11*d*. When the separation roller shaft 10*a* rotates opposite to the feeding direction, the frame collar 11*d* and the first collar 31 turn/stop as one-piece.

The second spring clutch 34, as a second clutch member which is formed as a substantially spiral spring similar to the first spring clutch 33, is wound around the outer surfaces of the second collar 32 and other part of the first collar 31, appearing to the other side of the parting wall 31 a as shown in FIG. 2. The winding direction of the second spring clutch 34 is opposite to that of the first spring clutch 33. When the separation roller shaft 10*a* rotates in the direction to feed the documents P in the feeding direction thereof, the spring of the second spring clutch 34 wraps so as to make the diameter thereof smaller. When the separation roller shaft 10*a* rotates opposite to the feeding direction, the spring of the second spring clutch 34 unwraps so as to make the diameter thereof larger. More specifically, when the separation roller shaft 10*a* rotates in the feeding direction thereof, the first and second collars 31, 32 rotate/stop, as one-piece. When the separation roller shaft 10*a* rotates opposite to the feeding direction, the first and second collars 31, 32 separately and independently rotate/stop.

Unlike the first spring clutch 33, the spring of the second spring clutch 34 continues to wrap, even when the separation roller shaft 10*a* rotates opposite to the feeding direction thereof, until a predetermined torque is produced. Therefore, the first and second collar 31, 32 continue to rotate/stop as one-piece. When the torque equal to or greater than the predetermined torque is produced, the spring of the second spring clutch 34 unwraps, so as to make the diameter thereof larger, similarly as the first spring clutch 33 works. Therefore, the first and second collars 31, 32 separately and independently rotate/stop.

In the first embodiment, the spring clutches 33, 34, which are formed like substantially spiral springs, are wound around the outer surfaces of the collars 11*d*, 31 and 32. However, two spring clutches, which are formed like substantially spiral springs, may be wound around the inner surfaces of the collars 11*d*, 31 and 32.

Figure 3:
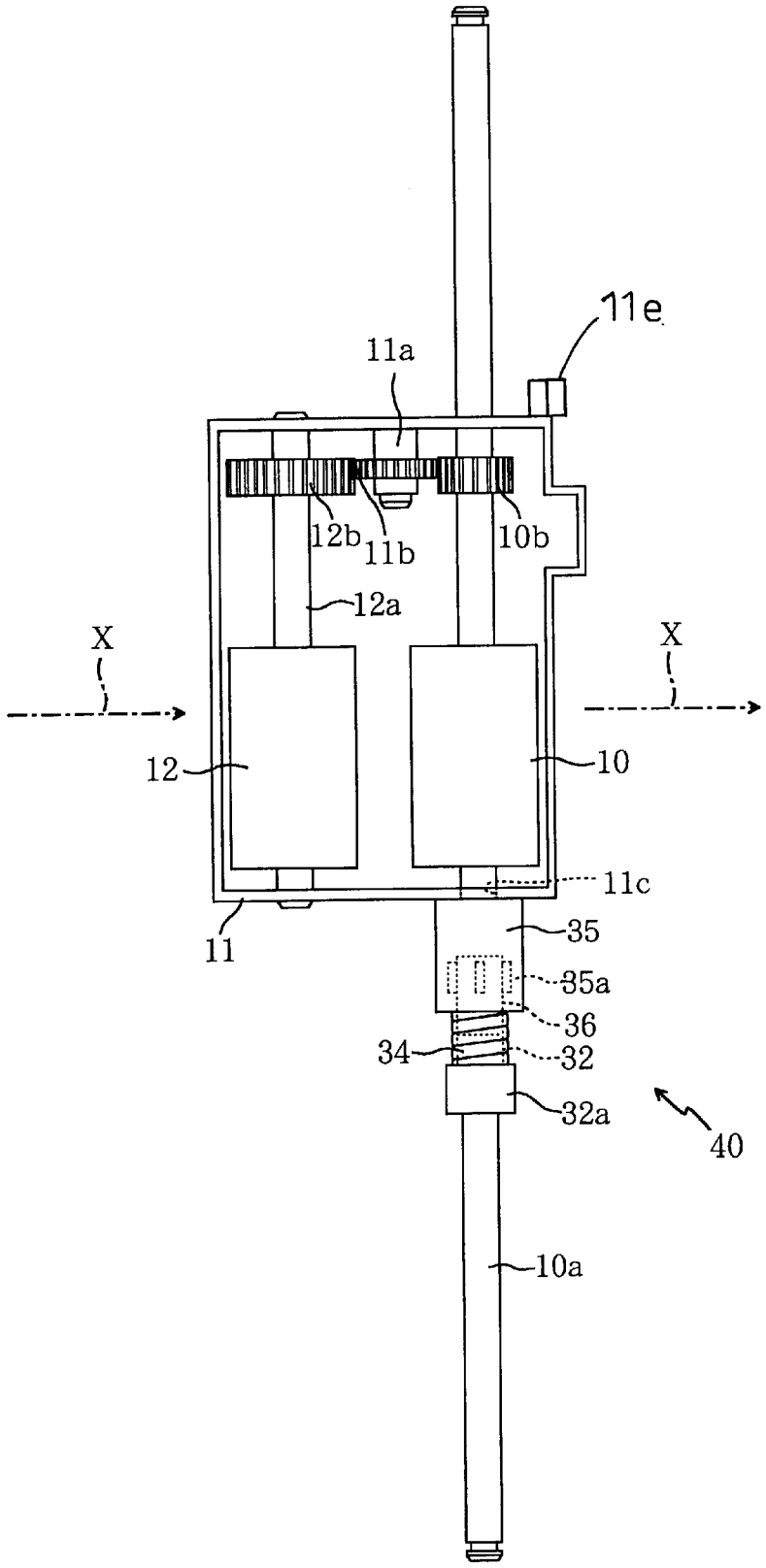
FIG. 3 is a plan view of the paper feeder according to a second embodiment of the invention.

With reference to FIG. 3, a second embodiment of the invention will be explained. FIG. 3 is a plan view of the paper feeder according to the second embodiment of the invention. To facilitate understanding of the paper feeder 1 according to the second embodiment, the upper, or cover, portion of the frame member 11 is not shown in FIG. 3, like in FIG. 2. The dot-dash lines with arrows X in FIG. 3 indicate the document P feeding direction, similar to those illustrated in FIG. 2. The difference between the first and second embodiments will be described below.

In the first embodiment, the first spring clutch 33, which is a spring-type one-way clutch, is used, as a first clutch member, for the lifting member 30. In the second embodiment, a bearing clutch 35, which is a bearing-type one-way clutch, is used, as a first clutch member, for the lifting member 40. It is to be noted in FIGS. 2 and 3 that similar reference numerals denote similar components, and the explanation thereof is omitted.

Near the insertion portion 11*c* in the frame member 11 for inserting the separation roller shaft 10*a* thereinto, the bearing clutch 35 projects outwardly while placing the separation roller shaft 10*a* therein. The bearing clutch 35 is integrated with the frame member 11. Inside the bearing clutch 35, the separation roller shaft 10*a* can rotate.

Between the body of the bearing clutch 35 and the separation roller shaft 10*a*, a first collar 36 is fitted. The first collar 36 and the separation roller shaft 10*a* can rotate.

Inside the bearing clutch 35, six cylindrical bearings 35*a* are supported by shafts, so as to rotate only in one direction. The six bearings 35*a* hold the first collar 36 so as to allow the first collar 36 to rotate only in the direction to feed the documents P in the feeding direction thereof.

When the separation roller shaft 10*a* rotates in the feeding direction, the bearings 35*a* rotate, and the first collar 36 rotates/stops independently of the bearing clutch 35. When the separation roller 10 rotates opposite to the feeding direction, the bearings 35*a* do not rotate and the bearing clutch 35 and the first collar 36 turn/stop as one-piece.

The spring clutch 34, as a second clutch member, which is formed like a substantially spiral spring, is wound around the outer surfaces of the first and second collars 36, 32. The structures and action of the second spring clutch 34 are the same as those in the first embodiment.

Figure 4A:
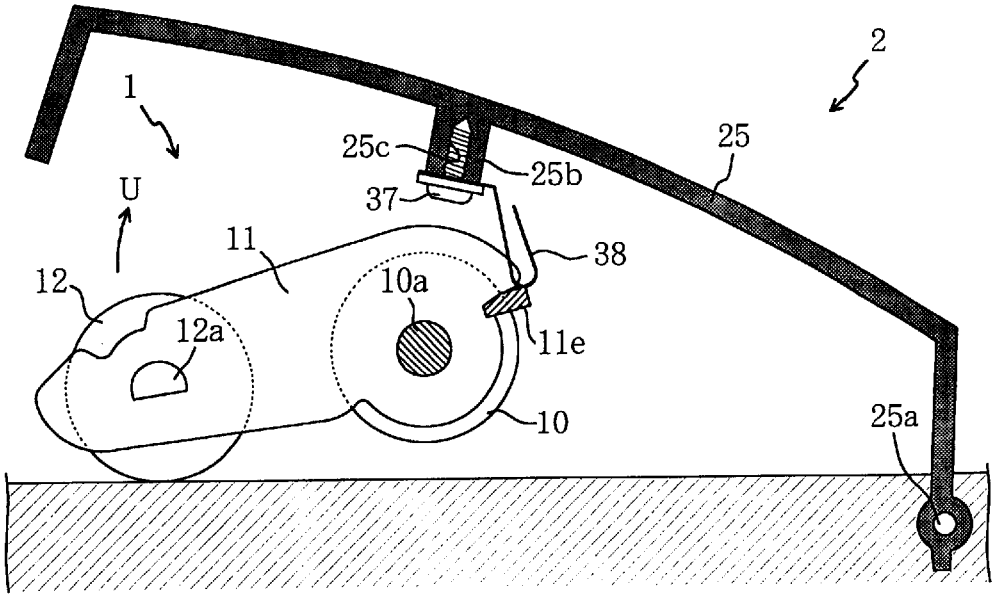
FIG. 4A is a schematic sectional side view of the paper feeder set inside the image reading device with a cover thereof open.
Figure 4B:
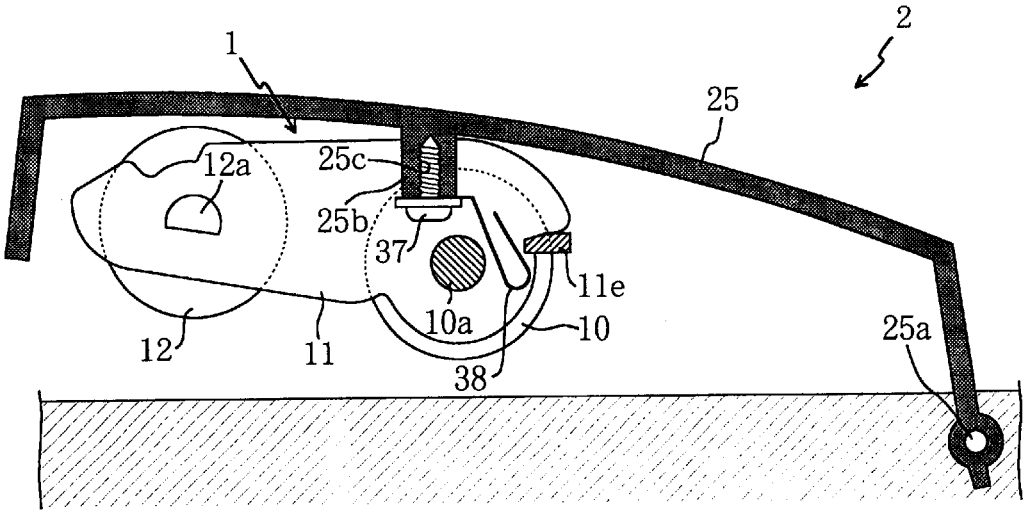
FIG. 4B is a schematic sectional side view of the paper feeder set inside the image reading device with a cover thereof closed.
Figure 5:
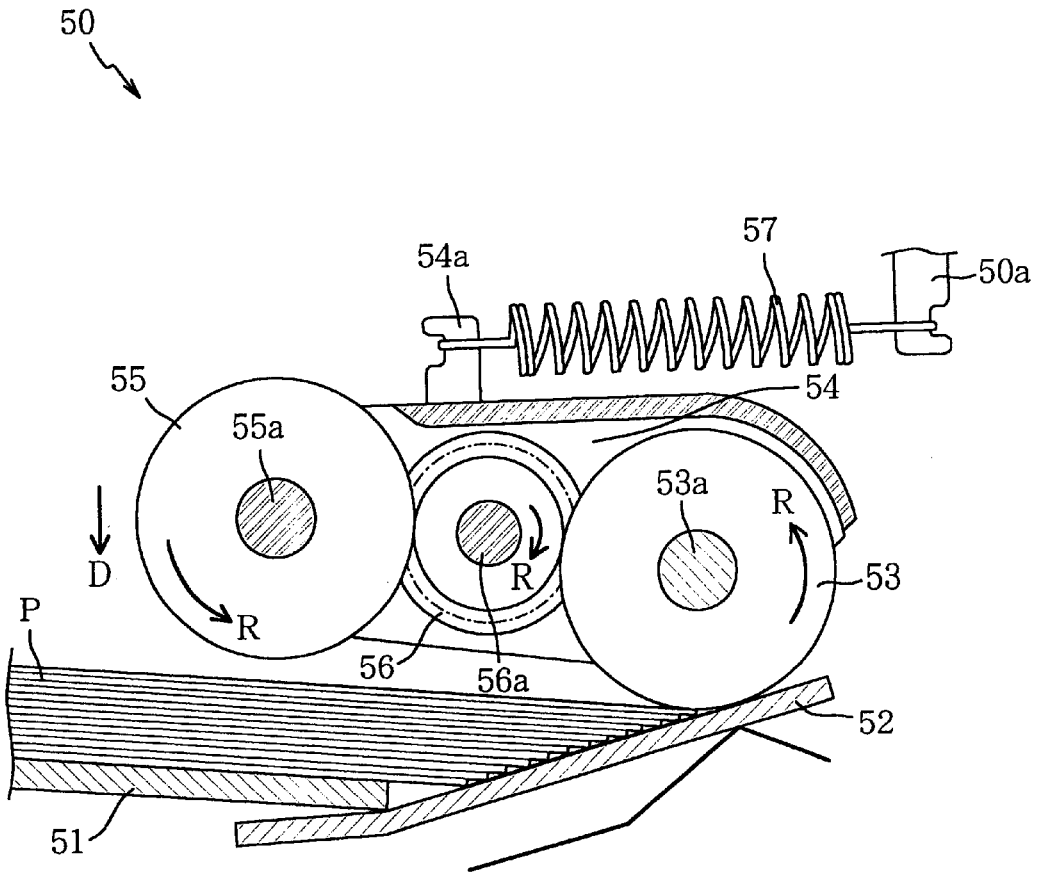
FIG. 5 is a partially schematic, sectional side view of a conventional paper feeder.

FIG. 4A is a schematic sectional side view of the paper feeder 1 set inside the image reading device 2 with the cover 25 open. FIG. 4B is a schematic sectional side view of the paper feeder 1 set inside the image reading device 2 with the cover 25 closed. As described above, the separation roller 10 is mounted on the separation roller shaft 10*a*, which extends through the frame member 11. The separation roller 10 is rotatably supported by the separation roller shaft 10*a* in the body of the image reading device 2.

Disposed on the document P feeding upstream side, in the frame member 11 (left side in FIGS. 4A and 4B), is the pick-up roller 12 that feeds out the separated individual pages of documents P, in the feeding direction thereof, similar to the separation roller 10. The pick-up roller 12 is rotatably supported by the pick-up roller shaft 12*a* in the frame member 11. The frame member 11, rotatably supporting the separation roller 10 and the pick-up roller 12 by means of shafts 10*a* and 12*a*, is supported in the body of the image reading device 2 so as to rotate about the separation roller shaft 10*a*.

The cover 25, to protect the image reading device 2, is provided in an upper portion of the paper feeder 1. Provided on the cover 25, at its downstream-side lower end in the document P feeding direction (right side in FIG. 4), is a hinge 25*a* that allows the cover 25 to pivot. The cover 25 opens and closes with respect to the hinge 25*a*. Formed at a substantially central portion of an inner surface of the cover 25 is a protrusion 25*b*. Provided in the central portion of the protrusion 25*b*, is a screw hole 25*c* into which a screw 37 is fitted. Disposed at the lower surface of the protrusion 25*b*, is a substantially L-shaped plate spring 38. The plate spring 38 is secured on the protrusion 25*b* of the cover 25 by the screw 37. An end of the plate spring 38 is curved like a hairpin.

A frame protrusion 1 le is provide on a side of the frame member 11, in a position where the lower end of the plate spring 38 presses down on the frame protrusion 11*e* as the cover 25 is closed. As shown in FIG. 4A, as the cover 25 is closed and the plate spring 38 presses down on the frame protrusion 11*e*, with the lower end thereof, the frame member 11 turns upwardly (in the direction indicated by arrow U), about the separation roller shaft 10*a*, so as to lift the pick-up roller 12. Thus, the pick-up roller 12 is lifted, every time the cover 25 is closed. Accordingly, a set of the documents P can be loaded, with the leading edges thereof set under the pick-up roller 12.

After the frame protrusion 11*e* is pressed by the lower end of the plate spring 38, the plate spring 38 slides off between the frame protrusion 11*e* and the separation roller shaft 10*a*, while being elastically deformed. As the document P feeding is started even with the frame member 11 lifted on the side of the pick-up roller 12, the frame member 11 can be turned downwardly about the separation roller shaft 10*a*, so as to lower the pick-up roller 12. Therefore, the document P feeding can be smoothly performed with the pick-up roller 12 lowered, even after the pick-up roller 12 is lifted as the cover 25 is closed.

Operations of the image reading device 2 having the paper feeder 1 therein, will be described below, with reference to FIG. 1. A set of the documents P is loaded on the paper feed tray 3 with the side having images facing up. When the set of documents P is inserted inward, as stacked, to set on the paper feed slope 4, the front actuator 5 rotates about the fulcrum 5*a*, while being pushed forward by the set of documents P in the document P feeding direction. By the rotation of the front actuator 5*a*, a sensor (not shown) senses the presence of the documents P on the paper feed slope 4. A user inserts the documents P, until leading edges of the documents P come to contact the lower surface of the separation roller 10 and the upper surface of the separation pad 6.

When an image reading switch (not shown) is turned on, the separation roller shaft 10*a* rotates in the direction to feed successive pages of the documents P in the feeding direction thereof, the frame member 11 turns downwardly about the separation roller shaft 10*a* (in the counterclockwise direction), so as to lower the pick-up roller 12. At the same time, the separation roller 10 and the pick-up roller 12 start to rotate in the direction to feed the documents P in the feeding direction thereof. The pages of the documents P contacting the surface of the separation pad 6, are dragged and separated one by one, by the separation pad 6. As the separation roller 10 and the pick-up roller 12 further rotate, the uppermost page of the documents P contacting the separation roller 10 is fed forward in the feeding direction thereof. The operations of the paper feeder 1 will be described in detail below.

The page of the documents P, fed by the separation roller 10, is transferred to the curved portion 15 by the first transferring roller 13 and the first presser roller 14. The page of the documents P is transferred at a predetermined velocity to the image reader 18, through the curved portion 15, by the second transferring roller 16 and the second presser roller 17.

The page of the documents P is transferred to the image reader 18, with the side having the images facing down. As the page of the documents P is transferred while being pressed by the platen roller 21 onto the image reading unit 20 provided with the CIS 19, the images on the page are read. The page of the documents P subjected to the image reading by the image reader 18 is transferred between the discharge roller 22 and the discharge presser roller 23. The page of the documents P is transferred at a predetermined velocity, as the discharge roller 22 rotates. Thus, the page of the documents P, subjected to the image reading, is discharged onto the discharge tray 24.

With reference to FIGS. 2 and 3, the operations of the paper feeder 1 will now be described in detail below. As the separation roller shaft 10*a* is rotated by a driving motor (not shown) in the direction to feed the documents P in the feeding direction thereof, the spring of the second spring clutch 34 wraps, so as to make the diameter thereof smaller. Accordingly, the first and second collars 31, 32 start to rotate as one-piece. As described above, the second collar 32 is fixedly inserted over the separation roller shaft 10*a*. The first collar 31 is rotatably inserted over the separation roller shaft 10*a*. In this case, the first and second collars 31, 32 rotate, together with the separation roller shaft 10*a*, as one-piece.

When the separation roller shaft 10*a* rotates in the direction to feed the documents P in the feeding direction thereof, the spring of the first spring clutch 33 unwraps, so as to make the diameter thereof larger. Accordingly, the first collar 31 rotates independently of the frame collar 11*d*. The frame collar 11*d*, integrated with the frame member 11, does not rotate. As described above, the first collar 31 rotates, together with the second collar 32 and the separation roller shaft 10*a*, as one-piece.

The bearing clutch 35, as the first clutch member, in the second embodiment, uses a similar principal as the first embodiment. When the separation roller shaft 10*a* rotates in the direction to feed the documents P in the feeding direction thereof, the first collar 36 rotates independently of the bearing clutch 35, as the bearings 35*a* rotate. The bearing clutch 35 integrated with the frame member 11 does not rotate.

The first collar 36 rotates, together with the second collar 32 and the separation roller shaft 10*a*, as one-piece, as described above.

When the separation roller shaft 10*a* rotates in the direction to feed the documents P in the feeding direction thereof, the separation roller 10 and the pick-up roller 12 cooperatively feed the pages of the documents P in the feeding direction thereof, as the separation roller shaft 10*a* rotates independently of the frame member 11.

When all pages of the documents P have been fed, the separation roller shaft 10*a* is rotated, by a driving motor (not shown), opposite to the direction to feed the documents P in the feeding direction thereof, by a predetermined amount. As the separation roller shaft 10*a* is rotated opposite to the feeding direction, the spring of the first spring clutch 33 wraps and that of the second spring clutch 34 unwraps differently than when as the separation roller shaft 10*a* rotates in the direction to feed the documents P in the feeding direction thereof.

When the separation roller shaft 10*a* is rotated opposite to the feeding direction, by the predetermined amount, the torque that is equal to or greater than the predetermined torque, is not produced on the separation roller shaft 10*a*. Accordingly, the spring of the second spring clutch 34 continues to wrap, so that the first and second collars 31, 32 rotate together with the separation roller shaft 10*a,* as one-piece. The spring of the first spring clutch 33 wraps, so as to make the diameter thereof smaller, so that the frame collar 11*d* and the first collar 31 turn as one-piece.

The frame collar 11*d,* and the first and second collars 31, 32 turn, as one-piece, together with the separation roller shaft 10*a*. Therefore, the power of the separation roller shaft 10*a,* rotating opposite to the direction to feed the documents P in the feeding direction thereof, is transmitted to the frame member 11. Due to the separation roller shaft 10*a* rotating opposite to the direction to feed the documents P in the feeding direction thereof, the frame member 11 on the side of the pick-up roller 12, is turned upwardly, so that the pick-up roller 12 is lifted up away from the paper feed slope 4 where the documents P are to be loaded.

The bearing clutch 35, as the first clutch member, in the second embodiment, uses the similar principal as the first embodiment. When the separation roller shaft 10*a* rotates opposite to the direction to feed the documents P in the feeding direction thereof, the bearing clutch 35 and the first collar 36 turn together, as one-piece, as the bearings 35*a* do not rotate. Accordingly, the bearing clutch 35, and the first and the second collars 36, 32 turn, as one-piece, together with the separation roller shaft 10*a*. As the separation roller 10 rotates opposite to the direction to feed the documents P in the feeding direction thereof, the rotation of the separation roller shaft 10*a,* is transmitted to the frame member 11. With the rotation of the separation roller shaft 10*a* transmitted to the frame member 11, the frame member 11 turns upwardly.

With the use of the bearing clutch 35, as the first clutch member, the separation roller shaft 10*a* can be rotated in the direction to feed the documents P in the feeding direction thereof, by rotating the first collar 36 independently of the bearing clutch 35. To turn the frame member 11 upwardly so as to lift the pick-up roller 12 from the documents P, the rotation of separation roller 10 is transmitted to the frame member 11, by turning the bearing clutch 35 and the first collar 36 together, as one-piece.

When the documents P are fed, a paper jam may occur. As a page of the documents P is manually pulled in the opposite direction from the document P feeding direction, to clear the paper jam, the torque equal to or greater than the predetermined torque, is produced on the separation roller shaft 10*a*. In such cases, the spring of the second spring clutch 34 unwraps, so as make the diameter thereof larger. Accordingly, the first and second collars 31, 32 separately and independently rotate. The first collar 31 becoming as one-piece with the frame collar 11*d* projecting from the frame member 11, lifts the frame member 11, and stops at a position where the frame member 11 is lifted. The second collar 32 continuously rotates, together with the separation roller shaft 10*a,* so that a user may easily remove the page of the documents P, by pulling the page in the direction opposite to the paper feeding direction.

With the above-described structure, the documents P are not susceptible to damage when the documents P are pulled out in the direction opposite to the paper feeding direction.

When a set of the documents P has been fed, the frame member 11 is lifted, as the separation roller shaft 10*a* is rotated opposite to the direction to feed the documents P in the feeding direction thereof, by the predetermined amount. Thereafter, when another set of the documents P is loaded and the feeding thereof is started, the separation roller shaft 10*a* is started to be rotated by the driving motor (not shown) in the direction to feed the documents P in the feeding direction thereof, as described above. In this case, the spring of the first spring clutch 33 wraps, so as to make the diameter thereof smaller, due to a force that the frame member 11 is trying to lower by its own weight. The spring of the second spring clutch 34 tends to unwrap so as to make the diameter thereof larger, due to a force that the frame member 11 is trying to lower by its own weight. However, as the torque equal to or greater than the predetermined torque is not produced on the separation roller shaft 10*a,* the spring of the second spring clutch 34 continues to wrap so as to make the diameter thereof smaller. Accordingly, the first and second collars 31, 32 and the frame collar 11*d* turn, as one-piece, together with the separation roller shaft 10*a*. The rotation of the separation roller shaft 10*a,* in the direction to feed the documents P in the feeding direction thereof, is directly transmitted to the frame member 11. Upon the transmission of the rotation of the separation roller shaft 10*a* to the frame member 11, the frame member 11, which has been lifted, is lowered, and the pick-up roller 12 contacts the upper surface of the page of the documents P stacked on the top. At the same time, the separation roller 10 and the pick-up roller 12 rotate in the feeding direction thereof, and feed the pages of the documents P in the feeding direction. The pages of the documents P are transferred as described above.

With reference to FIGS. 4A and 4B, manually lifting the frame member 11 by opening and closing the cover 25, will be described in detail below. As shown in FIG. 4A, the frame member 11 on the side of the pick-up roller 12, is lowered. When the cover 25 is turned about the hinge 25*a,* to close the cover 25, the plate spring 38 extending in an inner side of the cover 25, presses the upper portion of the frame protrusion 1*e* provided on the side of the frame member 11, with a portion curved substantially like a hairpin. The spring of the first spring clutch 33 unwraps, so that the first collar 31 rotates independently of the frame collar 11*d*. The frame member 11 turns about the separation roller shaft 10*a,* so as to raise the pick-up roller 12 (in the direction of the arrow U). At this time, the separation roller shaft 10*a* does not rotate but stops.

As the frame member 11 continues to turn in a direction that the pick-up roller 12 is raised (in the direction of the arrow U), the plate spring 38 is elastically deformed toward the separation roller 10 side, from the frame protrusion 11*e,* so that the plate spring 38 slips between the separation roller shaft 10*a* and the frame protrusion 11*e* (see FIG. 4B). Thereafter, the plate spring 38 does not press down the frame protrusion 11*e,* the frame member 11 is free from external forces applied thereto. When the frame member 11 starts to turn, due to the weight thereof, in a direction such that the pick-up roller 12 side is lowered, the spring of the first spring clutch 33 wraps, and the frame collar 11*d* and the first collar 31 become as one-piece and stop.

At this time, the torque equal to or higher than the predetermined torque is not acting on the separation roller shaft 10*a*. Therefore, the spring of the second spring clutch 34 continues to wrap, so that the first and second collars 31, 32 becoming as one-piece, still stop. The frame collar 11*d,* and the first and second collars 31, 32 all stop, without rotating. More specifically, the frame member 11 stays lifted on the pick-up roller 12 side thereof (see FIG. 4B), when the cover 25 is closed.

To resume the feeding of the documents P after the cover 25 is closed, the separation roller shaft 10a is rotated by the drive motor (not shown) in the direction to feed the documents P in the feeding direction thereof. In this case, the spring of the first spring clutch 33 wraps, so as to make the diameter thereof smaller, due to a force that the frame member 11 is trying to lower by its own weight. The spring of the second spring clutch 34 tends to unwrap, so as to make the diameter thereof larger, due to a force that the frame member 11 is trying to lower by its own weight. However, as the torque equal to or greater than the predetermined torque is not produced on the separation roller shaft 10*a,* the spring of the second spring clutch 34 continues to wrap, so as to make the diameter thereof smaller. Accordingly, the first and second collars 31, 32 and the frame collar 11*d* turn, as one-piece, together with the separation roller shaft 10*a*. The rotation of the separation roller shaft 10*a,* in the direction to feed the documents P in the feeding direction thereof is directly transmitted to the frame member 11. Upon the transmission of the rotation of the separation roller shaft 10*a* to the frame member 11, the frame member 11, which has been lifted, is lowered, and the pick-up roller 12 contacts the upper surface of the page of the documents P stacked on the top. At the same time, the separation roller 10 and the pick-up roller 12 rotate in the direction to feed the documents P in the feeding direction thereof, and feed the pages of the documents P in the feeding direction thereof. The pages of the documents P are transferred as described above.

As described above, in the paper feeder 1 according to the embodiments of the invention, the lifting members 30, 40 transmit the rotation of the separation roller shaft 10*a* to the frame member 11, as the separation roller shaft 10*a* is rotated opposite to the direction to feed the documents P in the feeding direction thereof, by the predetermined amount, after all pages of the documents P have been fed. Accordingly, the pick-up roller 12 side of the frame member 11 is turned upwardly, so as to become away from the paper feed slope 4 where the documents P are to be loaded. Thereafter, another set of the documents P can be readily loaded, with the leading edge thereof set under the pick-up roller 12. Further, the documents P may be stably feed out, because external forces, to raise the pick-up roller 12 side of the frame member 11, are not applied to the frame member 11 when the feeding of the documents P is started.

While the invention has been described with reference to the embodiments, it is to be understood that the invention is not restricted to the particular forms shown in the foregoing embodiments. Various modifications and alterations can be made thereto without departing from the scope of the invention.

For example, the paper feeder that feeds the documents P is explained in the embodiments of the invention. However, the invention may be applied to a paper feeder that feeds a print sheet.

Further, the invention may be applied to a feeder that feeds a transferring material of a fixed format other than a sheet of paper or a transferring material with some long length.

What is claimed is:

1. A paper feeder, comprising:

a separation roller that separates a plurality of stacked documents, one by one;

a pick-up roller that is disposed upstream of the separation roller in a document feeding direction, and that feeds the documents toward the separation roller;

a frame member through which a rotating shaft for the separation roller passes, the frame member supporting a rotating shaft for the pick-up roller; and a lifting member that turns the frame member in a direction away from a document positioning portion, so as to move the pick-up roller away from the document positioning portion, by transmitting a rotation of the rotating shaft for the separation roller, to the frame member, when the rotating shaft for the separation roller rotates opposite to a direction to feed the documents in the document feeding direction, wherein the lifting member includes:

a frame collar that projects from the frame member at an insertion portion of the rotating shaft for the separation roller in the frame member, the frame collar guiding the rotating shaft for the separation roller therethrough;

a first collar that is disposed near the frame collar and rotatably inserted over the rotating shaft for the separation roller;

a second collar that is disposed near a first collar end opposite to the frame collar, and fixedly inserted over the rotating shaft for the separation roller;

a first clutch member that connects the frame collar and the first collar, wherein when the rotating shaft for the separation roller rotates in the direction to feed the documents in the document feeding direction, the first clutch member causes the frame collar and the first collar to separately and independently act, and when the rotating shaft for the separation roller rotates opposite to the direction to feed the documents in the document feeding direction, the first clutch member causes the frame collar and the first collar to act as one-piece; and a second clutch member that connects the first collar and the second collar therein, wherein when the rotating shaft for the separation roller rotates in the direction to feed the documents in the document feeding direction, the second clutch member causes the first collar and the second collar to act as one-piece, and when the rotating shaft for the separation roller rotates opposite to the direction to feed the documents in the document feeding direction, the second clutch member causes the first collar and the second collar to act as one-piece, until a predetermined torque is produced on the rotating shaft for the separation roller, and the second clutch member causes the first collar and the second collar to separately and independently act, as a torque equal to or greater than the predetermined torque is produced on the rotating shaft for the separation roller, when the rotating shaft for the separation roller rotates opposite to the direction to feed the documents in the document feeding direction.

2. The paper feeder according to claim 1, wherein the first clutch member includes the frame collar and a bearing-type one-way clutch that allows the first collar to rotate only in the direction to feed the documents in the document feeding direction.

3. The paper feeder according to claim 1, wherein the second clutch member includes a spring-type one-way clutch that has a spring wound around outer surfaces of the first collar and the second collar;

when the rotating shaft for the separation roller rotates in the direction to feed the documents in the document feeding direction, an inside diameter of the spring surrounding the first collar and the second collar becomes smaller, the spring presses the outer surfaces of the first collar and the second collar, and the first collar and the second collar act as one-piece;

when the rotating shaft for the separation roller rotates opposite to the direction to feed the documents in the document feeding direction, with a torque less than the predetermined torque produced, the inside diameter of the spring surrounding the first collar and the second collar remains smaller, the spring presses the outer surfaces of the first collar and the second collar, and the first collar and the second collar act as one-piece; and when the rotating shaft for the separation roller rotates opposite to the direction to feed the documents in the document feeding direction, with the torque equal to or greater than the predetermined torque produced, the inside diameter of the spring surrounding the first collar and the second collar becomes larger than outside diameters of the first collar and the second collar, and the first collar and the second collar act separately and independently.

4. The paper feeder according to claim 1, further comprising:

a cover that covers the frame member;

a cover protruding member that is disposed in the cover on a side of the frame member; and a frame protruding member that is formed on the frame member, upstream of the separation roller in the document feeding direction, that lifts the frame member on a side of the pick-up roller by making the frame member rotate about the rotating shaft for the separation roller, with the frame protruding member, when the cover is closed.

5. The paper feeder according to claim 4, wherein the cover protruding member is formed of a plate spring.

6. A feeder, comprising:

a separation roller that separates a plurality of transferring materials, one by one;

a pick-up roller that is disposed upstream of the separation roller in a transferring material feeding direction, and that feeds the transferring materials toward the separation roller;

a frame member through which a rotating shaft for the separation roller passes, the frame member supporting a rotating shaft for the pick-up roller; and a lifting member that turns the frame member in a direction away from a transferring material positioning portion, so as to move the pick-up roller away from the transferring material positioning portion, by transmitting a rotation of the rotating shaft for the separation roller, to the frame member, when the rotating shaft for the separation roller rotates opposite to a direction to feed the transferring materials in the transferring material feeding direction, wherein the lifting member includes:

a frame collar that projects from the frame member and that allows the rotating shaft for the separation roller to pass through;

a first collar that is disposed near the frame collar and rotatably inserted over the rotating shaft for the separation roller;

a second collar that is disposed near a first collar end opposite to the frame collar, and fixed to the rotating shaft for the separation roller;

a first clutch member that disengages the frame collar and the first collar when the rotating shaft for the separation roller rotates in the direction to feed the transferring materials in the feeding direction thereof, and that engages the frame collar and the first collar when the rotating shaft for the separation roller rotates opposite to the direction to feed the transferring materials in the feeding direction thereof; and a second clutch member that engages the first collar and the second collar when the rotating shaft for the separation roller rotates in the direction to feed the transferring materials in the feeding direction thereof, and until a predetermined torque is produced on the rotating shaft for the separation roller, when the rotating shaft for the separation roller rotates opposite to the direction to feed the transferring materials in the feeding direction thereof, and that disengages the first collar and the second collar, as a torque equal to or greater than the predetermined torque is produced on the rotating shaft for the separation roller, when the rotating shaft for the separation roller rotates opposite to the direction to feed the transferring materials in the feeding direction thereof.

7. The feeder according to claim 6, wherein the first clutch member includes the frame collar and a bearing-type one-way clutch that allows the first collar to rotate only in the direction to feed the transferring materials in the feeding direction thereof.

8. The feeder according to claim 6, wherein the first clutch member includes a spring-type one-way clutch.

9. The feeder according to claim 6, wherein the second clutch member includes a spring-type one-way clutch that has a spring wound around outer surfaces of the first collar and the second collar;

when the rotating shaft for the separation roller rotates in the direction to feed the transferring materials in the feeding direction thereof, an inside diameter of the spring surrounding the first collar and the second collar becomes smaller, the spring presses the outer surfaces of the first collar and the second collar, and the first collar and the second collar engage;

when the rotating shaft for the separation roller rotates opposite to the direction to feed the transferring materials in the feeding direction thereof, with a torque less that the predetermined torque produced, the inside diameter of the spring surrounding the first collar and the second collar remains smaller, the spring presses the outer surfaces of the first collar and the second collar, and the first collar and the second collar engage; and when the rotating shaft for the separation roller rotates opposite to the direction to feed the transferring materials in the feeding direction thereof, with the torque equal to or greater than the predetermined torque produced, the inside diameter of the spring surrounding the first collar and the second collar becomes larger than outside diameters of the first collar and the second collar, and the first collar and the second collar disengage.

10. The feeder according to claim 6, further comprising:

a cover that covers the frame member;

a cover protruding member that is disposed in the cover on a side of the frame member; and a frame protruding member that is formed on the frame member upstream of the separation roller in the transferring material feeding direction and that turns about the rotating shaft for the separation roller, so as to lift the frame member on a side of the pick-up roller, with the frame protruding member, when the cover is closed.

11. The feeder according to claim 10, wherein the cover protruding member is formed of a plate spring.

12. The feeder according to claim 6, wherein the transferring materials are documents.

13. The feeder according to claim 6, wherein the transferring materials are print sheets.

14. A paper feeder, comprising:

a separation roller that separates a plurality of stacked documents, one by one;

a pick-up roller that is disposed upstream of the separation roller in a document feeding direction, and that feeds the documents toward the separation roller;

a frame member through which a rotating shaft for the separation roller passes, the frame member supporting a rotating shaft for the pick-up roller;

a lifting member that turns the frame member in a direction away from a document positioning portion, so as to move the pick-up roller away from the document positioning portion, by transmitting a rotation of the rotating shaft for the separation roller, to the frame member, when the rotating shaft for the separation roller rotates opposite to a direction to feed the documents in the document feeding direction;

a cover that covers the frame member;

a cover protruding member that is disposed in the cover on a side of the frame member; and a frame protruding member that is formed on the frame member, upstream of the separation roller in the document feeding direction, that lifts the frame member on a side of the pick-up roller by making the frame member rotate about the rotating shaft for the separation roller, with the frame protruding member, when the cover is closed.

15. The paper feeder according to claim 14, wherein the cover protruding member is formed of a plate spring.

16. A feeder, comprising:

a separation roller that separates a plurality of transferring materials, one by one;

a pick-up roller that is disposed upstream of the separation roller in a transferring material feeding direction, and that feeds the transferring materials toward the separation roller;

a frame member through which a rotating shaft for the separation roller passes, the frame member supporting a rotating shaft for the pick-up roller;

a lifting member that turns the frame member in a direction away from a transferring material positioning portion, so as to move the pick-up roller away from the transferring material positioning portion, by transmitting a rotation of the rotating shaft for the separation roller, to the frame member, when the rotating shaft for the separation roller rotates opposite to a direction to feed the transferring materials in the transferring material feeding direction;

a cover that covers the frame member;

a cover protruding member that is disposed in the cover on a side of the frame member; and a frame protruding member that is formed on the frame member upstream of the separation roller in the transferring material feeding direction and that turns about the rotating shaft for the separation roller, so as to lift the frame member on a side of the pick-up roller, with the frame protruding member, when the cover is closed.

17. The feeder according to claim 16, wherein the cover protruding member is formed of a plate spring.

* * * * *